US008023860B2

(12) United States Patent
Choi et al.

(10) Patent No.: US 8,023,860 B2
(45) Date of Patent: Sep. 20, 2011

(54) DEVELOPING-TRANSFERRING MODULE AND IMAGE FORMING APPARATUS HAVING THE SAME

(75) Inventors: Min-ho Choi, Suwon-si (KR); Jong-woo Kim, Yongin-si (KR); Kyung-hwan Kim, Seongnam-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 498 days.

(21) Appl. No.: 12/013,623

(22) Filed: Jan. 14, 2008

(65) Prior Publication Data

US 2008/0170881 A1 Jul. 17, 2008

(30) Foreign Application Priority Data

Jan. 16, 2007 (KR) ..... 10-2007-0004920

(51) Int. Cl.
*G03G 21/18* (2006.01)

(52) U.S. Cl. ..... 399/112; 399/113

(58) Field of Classification Search ..... 399/113, 399/121, 302, 308, 313, 112
See application file for complete search history.

(56) References Cited

U.S. PATENT DOCUMENTS 6,484,003 B2 * 11/2002 Tokutake et al. ..... 399/110
6,522,845 B2 * 2/2003 Sameshima ..... 399/88
6,738,590 B2 * 5/2004 Okimura et al. ..... 399/111
7,085,517 B2 * 8/2006 Sameshima ..... 399/111
7,218,868 B2 * 5/2007 Ahn et al. ..... 399/13
7,340,199 B2 * 3/2008 Ito et al. ..... 399/116

FOREIGN PATENT DOCUMENTS

| | | | |
|---|---|---|---|
| CN | 1477457 | | 2/2004 |
| EP | 1387226 | | 2/2004 |
| JP | 2-165166 | | 6/1990 |
| JP | 5-27544 | | 2/1993 |
| JP | 7-152303 | | 6/1995 |
| JP | 09179475 | A * | 7/1997 |
| JP | 2001249508 | A * | 9/2001 |
| JP | 2004029609 | A * | 1/2004 |
| KR | 1994-10127 | | 10/1994 |

OTHER PUBLICATIONS

Chinese Office Action issued Dec. 31, 2010 in CN Application No. 200810001572.6.
Korean Office Action issued Jun. 13, 2011 in KR Application No. 10-2007-0004920.

* cited by examiner

*Primary Examiner* — Robert Beatty
(74) *Attorney, Agent, or Firm* — Stanzione & Kim, LLP

(57) ABSTRACT

A developing-transferring module includes a sub frame which is detachably mounted to a main frame, a plurality of photosensitive units which are disposed inside the sub frame with a predetermined interval and includes a photosensitive body to which a developer is attached, and a intermediate transferring unit which are provided inside the sub frame disposed opposite the plurality of photosensitive units so that the developer of the photosensitive units can be primarily transferred thereto and secondarily transfers the primarily transferred developer to a record medium of the main frame.

37 Claims, 10 Drawing Sheets

DEVELOPING-TRANSFERRING MODULE AND IMAGE FORMING APPARATUS HAVING THE SAME

CROSS-REFERENCE TO RELATED APPLICATIONS

This application claims priority under 35 U.S.C. §119(a) from Korean Patent Application No. 10-2007-0004920, filed on Jan. 16, 2007 in the Korean Intellectual Property Office, the disclosure of which is incorporated herein in its entirety by reference.

BACKGROUND OF THE INVENTION

1. Field of the Invention

A developing-transferring module and image forming apparatus having the same in accordance with the present general inventive concept relate to improving a development configuration and a transfer configuration to minimize a color alignment deviation.

2. Description of the Related Art

In general, an image forming apparatus visualizes an image data to a record medium depending on a print signal supplied from a host. The image forming apparatus includes a record medium supplying unit loading the record medium, an image forming unit forming an image to the record medium of the record medium supplying unit, and a record medium discharging unit discharging the record medium formed with the image. In the image forming apparatus, there are a mono type visualizing the image data to the record medium in a black and white image, and a color type visualizing a color image to the record medium by a combination of four color (yellow, magenta, cyan and black) developers.

FIG. 1A is a schematic view illustrating a configuration of a conventional color type image forming apparatus 10. As illustrated therein, a conventional image forming apparatus 10 includes a record medium supplying unit (not illustrated) loading a record medium using a developing roller 22 and a photosensitive body 21, developing units 20Y, 20M, 20C and 20K of each color applying a developer to the record medium using a developing roller 22 and a photosensitive body 21, a intermediate transferring belt 41 sequentially transporting the record medium to the developing units 20Y, 20M, 20C and 20K of each color and transferring the developer to the record medium, and a light exposing unit 30 scanning light to the photosensitive body 21 to form an electrostatic latent image on the photosensitive body 21.

An image forming method of the conventional image forming apparatus 10 is as follows. If a print signal is supplied from a host, a record medium picked up from the record medium supplying unit is transported along the intermediate transferring belt 41, and is contacted with the photosensitive body 21 of the developing unit 20 of each color. Here, a transferring roller 45 provided to a rear surface of the intermediate transferring belt 41 to correspond to the photosensitive body 21 of each color supplies a predetermined transferring voltage to transfer a developer on a surface of the photosensitive body 21 to the record medium, thereby forming an image. Here, at least two color developers are overlapped. The record medium is formed with a color image of various colors, and is discharged to the outside.

Here, if an alignment of the developer of each color applied to the record medium according to transporting of the intermediate transferring belt 41 aligns with each other, an image having a clear color is expressed as illustrated in area L of FIG. 1B. However, if the alignments of the developers of different colors do not accurately align with each other, color of an image data printed to the record medium is not clear as illustrated in area M of FIG. 1B, thereby deteriorating a print quality.

In the conventional image forming apparatus 10, each developing unit 20 is separated one another, and the intermediate transferring belt 41 is provided to be separable since the intermediate transferring belt 41 should be separated from the developing unit 20 if a record medium jam occurs on the intermediate transferring belt 41. Accordingly, a color alignment inferiority may be due to an assembling tolerance between the plurality of photosensitive bodies 21 and the intermediate transferring belt 41 in separating and coupling of the intermediate transferring belt 41, a meandering of the intermediate transferring belt 41, and a un-uniform line speed of the intermediate transferring belt 41, etc.

Also, if the temperature of the inside of the image forming apparatus 10 increases due to a long time use, a color alignment inferiority due to the un-uniform line speed because of heat deformation of a driving roller 43 of the intermediate transferring belt 41, and an angle variation of a reflecting mirror because of heat deformation of a frame of the light exposing unit 30 is caused.

To solve the color alignment inferiorities, the conventional image forming apparatus corrects the color alignment inferiorities through an auto color registration. However, if the auto color registration is executed, a separate time is necessary to provide the auto color registration after supplying of a print signal, and a print time is delayed despite printing a single record medium. Accordingly, inconvenience to a user occurs.

SUMMARY OF THE INVENTION

The present general inventive concept provides a developing-transferring module and an image forming apparatus having the same integrally providing a developing unit and a transferring unit, thereby minimizing a color alignment inferiority.

The present general inventive concept provides a developing-transferring module and an image forming apparatus having the same minimizing a time necessary to provide an automatic color alignment, thereby reducing a print time.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept can be achieved by providing a developing-transferring module, comprising a sub frame which is detachably mounted to a main frame, a plurality of photosensitive units which are disposed inside the sub frame and have a predetermined interval therebetween, and comprise a photosensitive body to which a developer is attached and a intermediate transferring unit which are provided inside the sub frame to face the plurality of photosensitive units so that the developer of the photosensitive units can be primarily transferred thereto, and secondarily transfers the primarily transferred developer to a record medium of the main frame.

The intermediate transferring unit may comprise a intermediate transferring drum.

The photosensitive units may comprise a charging roller which charges the photosensitive body to have a predetermined electrical potential.

The developing-transferring module may further comprise a developer storing unit which is coupled to the sub frame to supply the developer to the photosensitive body.

The developer storing unit may be integrally coupled to the sub frame.

The developer storing unit may comprise a developing roller which applies the developer to the photosensitive body, a developer storing unit which stores the developer, and a supplying roller which supplies the developer of the developer storing unit to the developing roller.

The developing-transferring module may further comprise a transferring roller which is provided to one side of the intermediate transferring unit to supply a predetermined transferring voltage so that the developer of the intermediate transferring unit can be transferred to the record medium.

The transferring roller may be integrally provided with the sub frame.

The foregoing and/or other aspects and utilities of the present general inventive concept can also be achieved by providing an image forming apparatus, comprising a main frame, a record medium supplying unit which is provided to a first side of the main frame and stores a record medium, a developing-transferring module including a sub frame which is detachably mounted to the main frame, a plurality of photosensitive units which are disposed inside the sub frame and have a predetermined interval therebetween, and comprise a photosensitive body to which a developer is attached, and a intermediate transferring unit which are provided inside the sub frame disposed opposite the plurality of photosensitive units so that the developer of the photosensitive units can be primarily transferred thereto, and secondarily transfers the primarily transferred developer to a record medium of the main frame, and a light exposing unit which is provided to a second side of the main frame to form an electrostatic latent image to the photosensitive body of the developing-transferring module.

The main frame may include a developing-transferring module holder which supports the developing-transferring module detachably mounted to the main frame.

The developing-transferring module holder may move between a supporting position in which the developing-transferring module holder contact-supports the developing-transferring module, and a distanced position in which the developing-transferring module holder is distanced from the developing-transferring module so that the developing-transferring module can be detached from the main frame.

The main frame may comprise a driving unit which generates a driving force, and a transmitting unit which transmits the driving force of the driving unit to the intermediate transferring unit of the developing-transferring module.

The interlocking unit may comprise a driving gear, and the intermediate transferring unit comprises a intermediate transferring gear which is engaged with the driving gear.

The plurality of photosensitive bodies may comprise a plurality of photosensitive body driving gears which rotate to engage with the intermediate transferring gear, and the plurality of photosensitive body driving gears are assembled to the intermediate transferring gear to minimize a color alignment deviation of each photosensitive body which applies the developer to the intermediate transferring unit.

The light exposing unit may comprise a light emitting diode (LED) array head.

The main frame may comprise a cover through which the developing-transferring module is carried in and out.

The cover may be provided to the main frame in a transverse direction to a rotation axis of the intermediate transferring unit.

The cover may be provided in a rotation axis direction of the intermediate transferring unit.

The foregoing and/or other aspects and utilities of the present general inventive concept can also be achieved by providing a developing-transferring module usable with an image forming apparatus, comprising a plurality of photosensitive bodies which are disposed with a predetermined interval and a intermediate transferring unit which are integrally provided with the photosensitive bodies disposed opposite the photosensitive bodies so that developer of the photosensitive bodies can be primarily transferred thereto.

The developing-transferring module may further comprise a sub frame which supports the photosensitive bodies and the intermediate transferring unit together.

The intermediate transferring unit may comprise a intermediate transferring drum.

The foregoing and/or other aspects and utilities of the general inventive concept may also be achieved by providing a developing-transferring unit usable with an image forming apparatus having a main frame, the unit comprising a plurality of photosensitive units, a intermediate transferring unit and a sub frame detachably mounted to the main frame to support the plurality of the photosensitive units and the intermediate transferring unit so that a relative position therebetween is maintained.

The foregoing and/or other aspects and utilities of the general inventive concept may also be achieved by providing an image forming apparatus comprising a main frame, and a developing-transferring unit comprising a plurality of photosensitive units, a intermediate transferring unit and a sub frame detachably mounted to the main frame to support the plurality of the photosensitive units and the intermediate transferring unit so that a relative position therebetween is maintained.

The foregoing and/or other aspects and utilities of the general inventive concept may also be achieved by providing a developing-transferring unit comprising a intermediate transferring drum having a periodic vibration property in a rotational state and a photosensitive unit to engage the intermediate transferring drum, wherein the photosensitive unit is assembled to minimize a phase difference between the photosensitive unit and the intermediate transferring drum based on the periodic vibration property in the rotational state of the intermediate transferring drum.

The foregoing and/or other aspects and utilities of the general inventive concept may also be achieved by providing an image forming apparatus comprising a sub frame and a developing-transferring unit coupled to the sub frame comprising a intermediate transferring drum having a periodic vibration property in a rotational state and a photosensitive unit to engage the intermediate transferring drum, wherein the photosensitive unit is assembled to minimize a phase difference between the photosensitive unit and the intermediate transferring drum based on the periodic vibration property in the rotational state of the intermediate transferring drum.

The foregoing and/or other aspects and utilities of the general inventive concept may also be achieved by providing an image forming apparatus comprising an accommodating unit including a supporter holder unit having a first position and a second position and a developing-transferring unit detachably mounted to the supporter holder unit, wherein the supporter holder unit is attached to the developing-transferring unit in the first position and is detached from the developing-transferring unit in the second position.

An image forming apparatus comprising a main frame having a structure to feed a record medium, and a driving unit, and a developing-transferring unit having a sub frame and a structure to develop an image with a developer and to transfer the developed image to the record medium, in a single body, to be inserted into the main frame, and to be connected to the driving unit when being mounted in the main frame.

An image forming apparatus comprising a main frame having a structure to feed a record medium, a sub-structure to receive an external developing-transferring unit in a single body in an insertion direction and to move the received external developing-transferring unit between an insertion position and a mounted position in a mounting direction, and a driving unit to supply a driving force to the developing-transferring unit in the mounted position.

An image forming apparatus comprising a developing-transferring unit having a sub frame to be inserted into an external main frame having a structure to feed a record medium and a structure formed into the sub frame as a single body to develop an image with a developer and transfer the developed image to the record medium of the main frame.

BRIEF DESCRIPTION OF THE DRAWINGS

The above and/or other aspects and utilities of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1A:
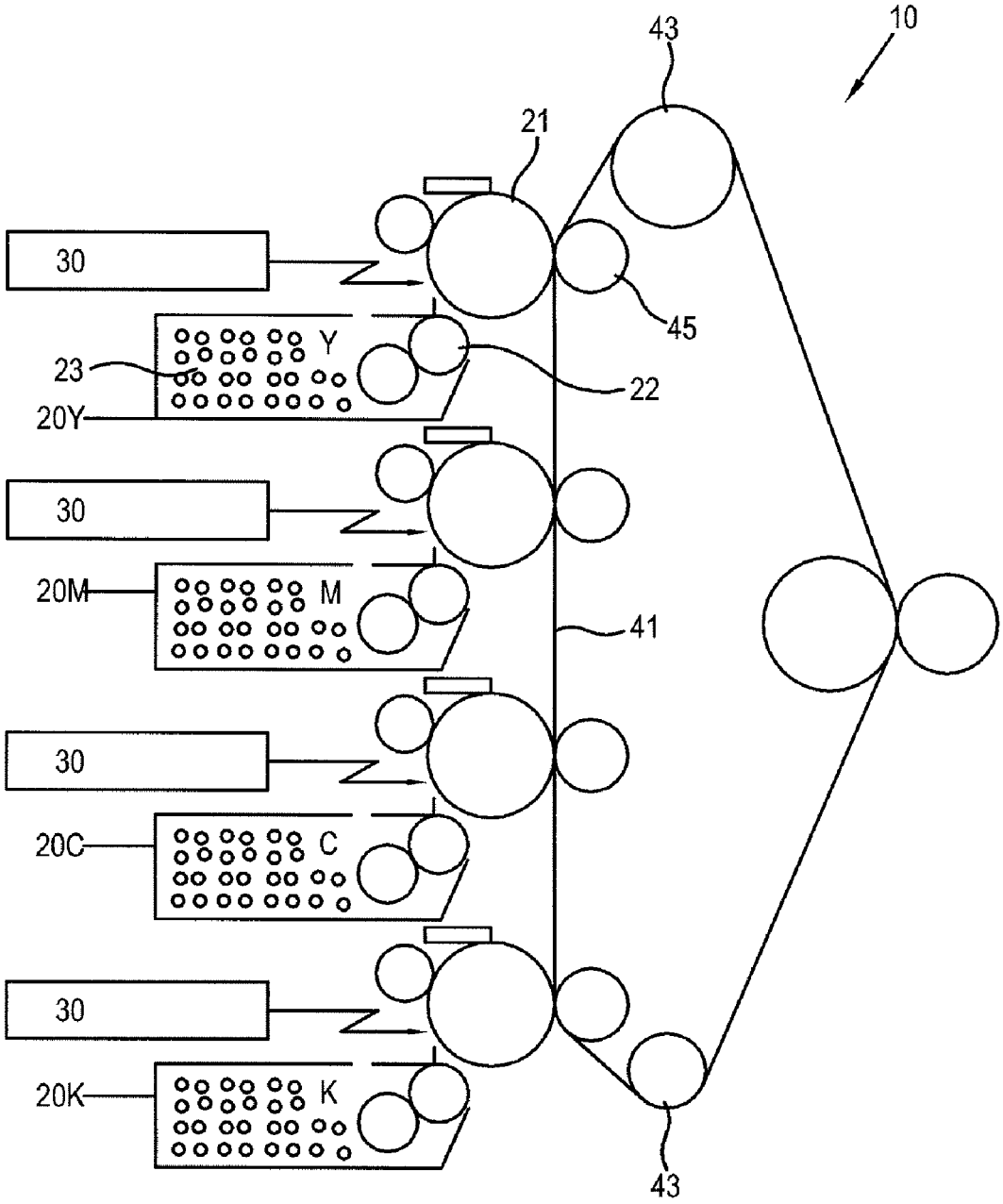
FIG. 1A (PRIOR ART)
FIG. 1A schematically illustrates a configuration of a conventional image forming apparatus.
Figure 1B:
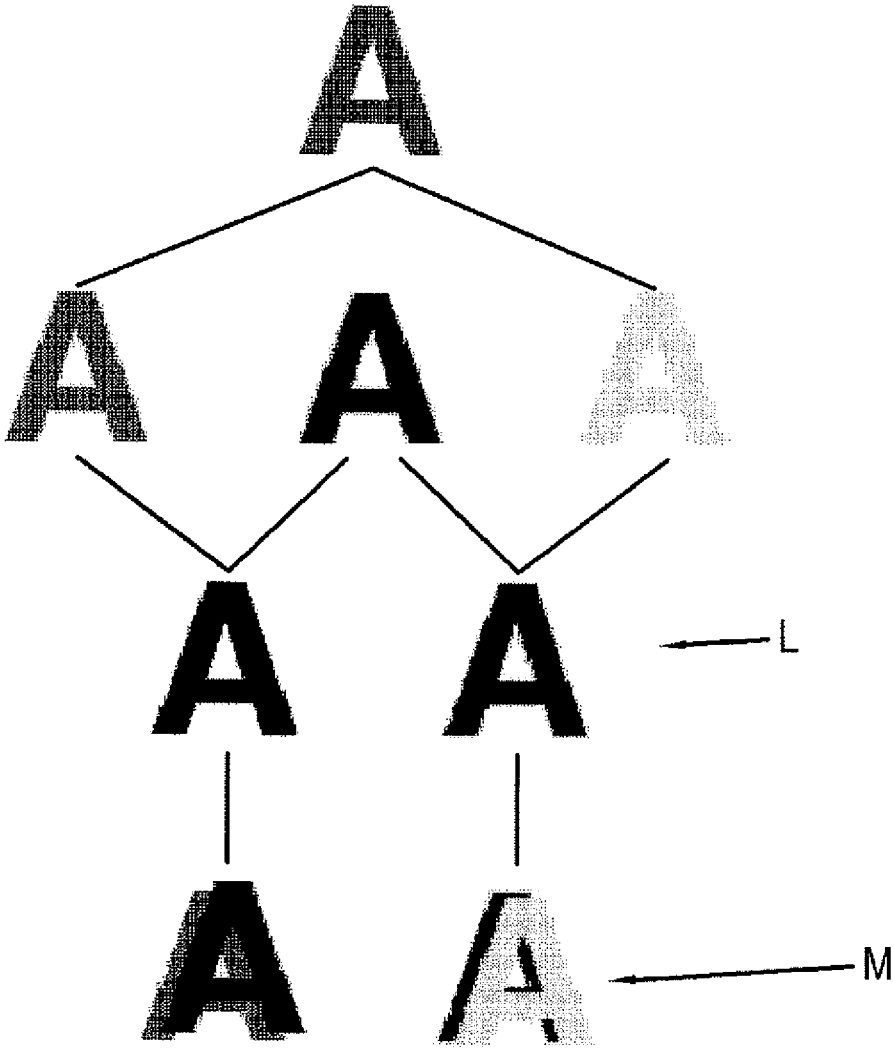
FIG. 1B illustrates an example of a color alignment inferiority of a record medium printed by the conventional image forming apparatus.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Figure 2A:
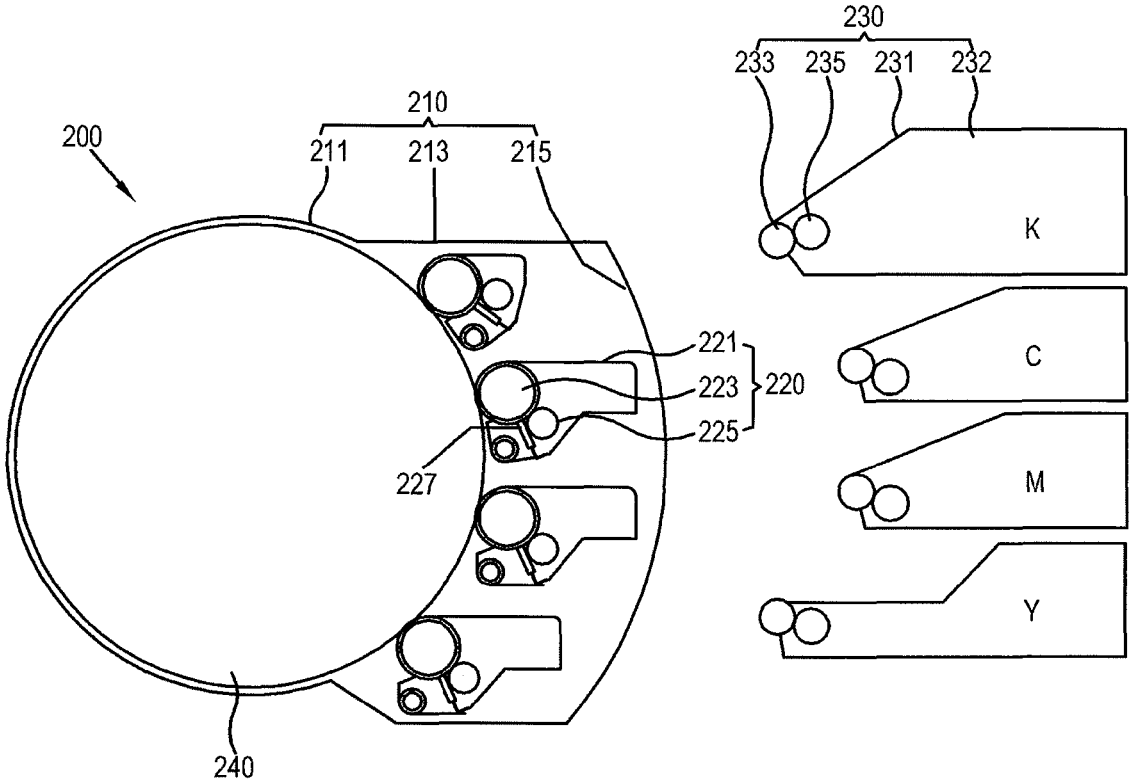
FIGS. 2A and 2B are an exploded sectional view and an assembled sectional view illustrating a configuration of a developing-transferring module according to an exemplary embodiment of the present general inventive concept.
Figure 2B:
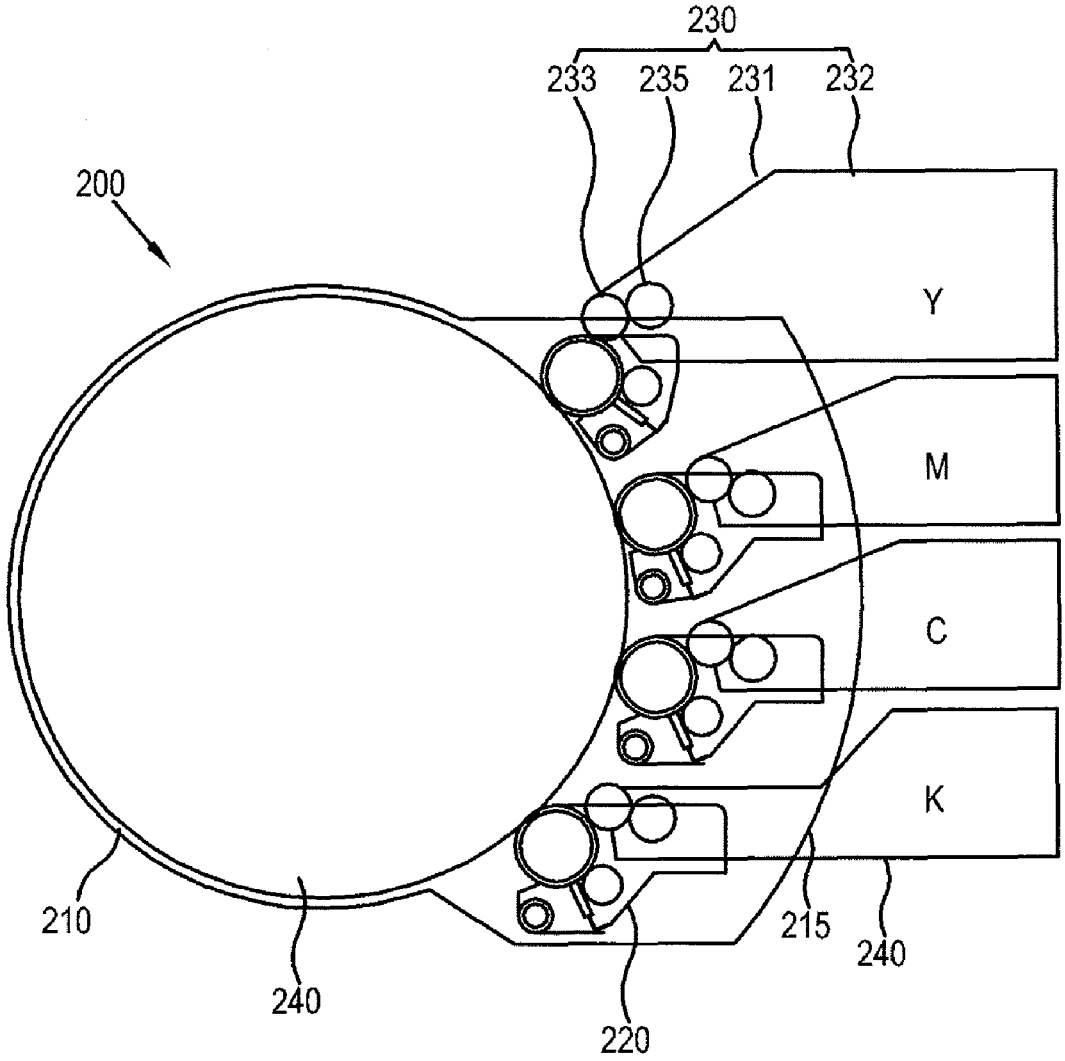
Figure 4A:
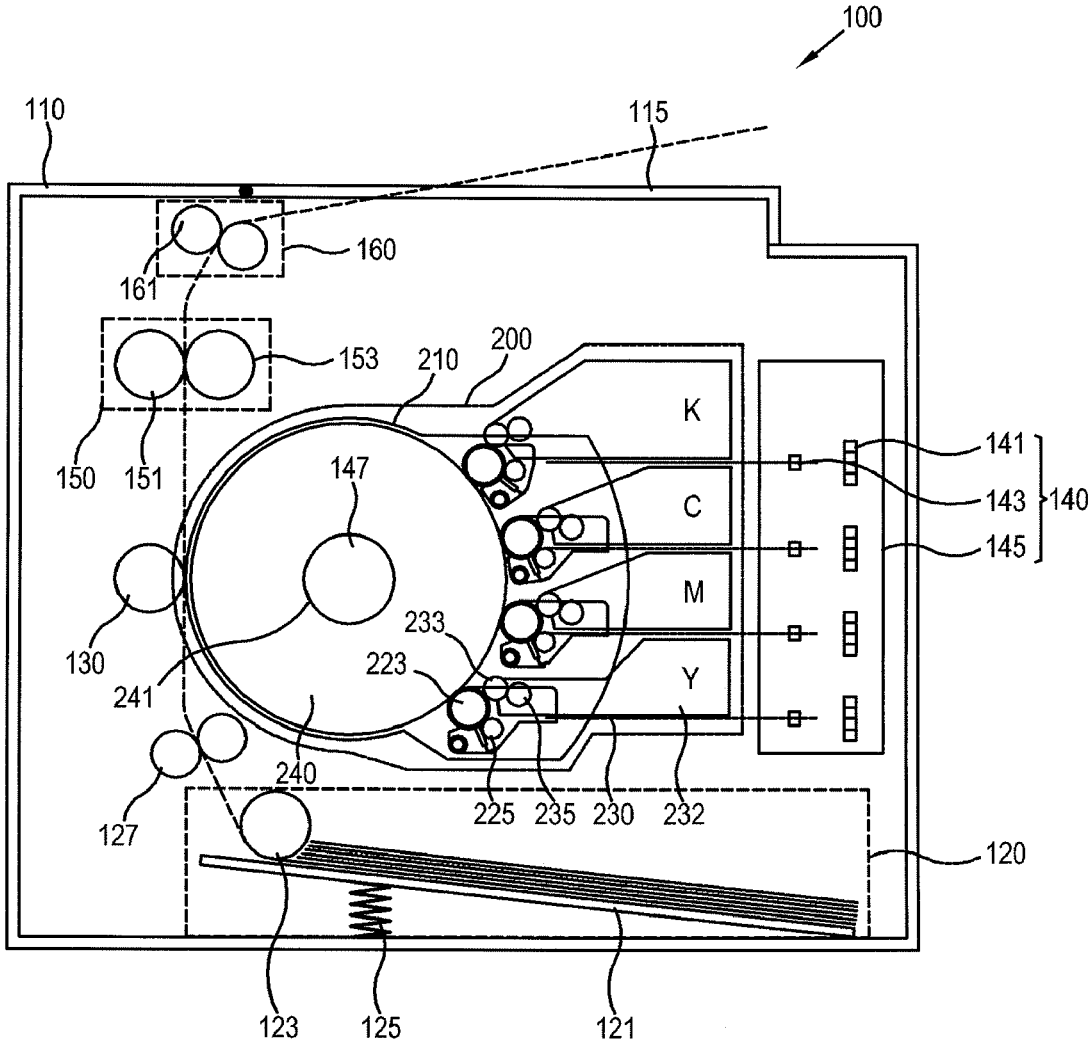
FIG. 4A is a sectional view illustrating a configuration of an image forming apparatus mounted with the developing-transferring module according to the exemplary embodiment of the present general inventive concept.
Figure 4B:
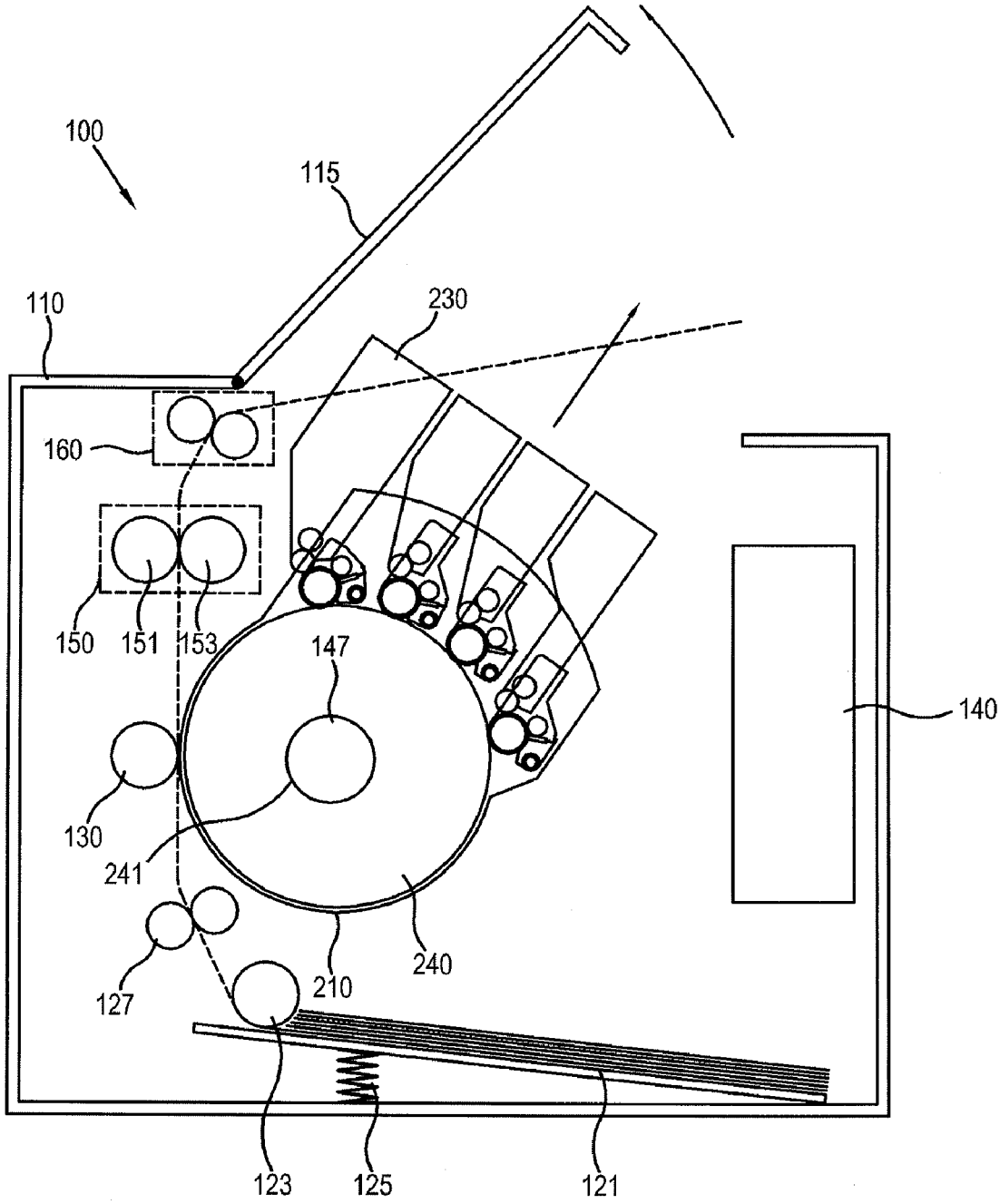
FIG. 4B is a sectional view illustrating a configuration of the image forming apparatus from which the developing-transferring module according to the exemplary embodiment of the present general inventive concept is being detached.

FIGS. 2A and 2B are schematic views illustrating a configuration of a developing-transferring module 200 according to an exemplary embodiment of the present general inventive concept, and FIGS. 4A and 4B are schematic views illustrating a configuration of an image forming apparatus 100 according to the exemplary embodiment of the present general inventive concept.

As illustrated therein, the developing-transferring module 200 according to the exemplary embodiment of the present general inventive concept includes a sub frame 210 detachably coupled to a main frame 110 of the image forming apparatus 100, a photosensitive unit 220 disposed to a side of the sub frame 210 and having a predetermined interval therebetween, and a intermediate transferring unit 240 rotatably mounted in the sub frame 210, primarily transferred with a developer of the photosensitive unit 220, and secondarily transferring the developer to a record medium of the main frame 110. Also, the developing-transferring module 200 may be coupled to a developer storing unit 230 to supply the developer to the photosensitive unit 220.

As illustrated in FIG. 2A, the sub frame 210 supports a plurality of photosensitive units 220 and the intermediate transferring unit 240 with respect to the main frame 110, and protects them from an external impact. The sub frame 210 supports the plurality of photosensitive units 220 and the intermediate transferring unit 240 so that a relative position between the plurality of photosensitive units 220 and the intermediate transferring unit 240 can be uniformly maintained. Here, the plurality of photosensitive units 220 are distanced from the intermediate transferring unit 240, thereby minimizing discordance of a color alignment.

The sub frame 210 includes a intermediate transferring housing 211 to support the intermediate transferring unit 240, and a photosensitive body supporting unit 213 to support the plurality of photosensitive units 220. The intermediate transferring housing 211 supports the opposite end portions of a rotation shaft of the intermediate transferring unit 240 except a central area thereof contacted with the record medium with respect to the main frame 110. That is, the central area of the intermediate transferring unit 240 is exposed to the record medium and the photosensitive units 220 The intermediate transferring housing 211 may stably support the intermediate transferring unit 240 so that a position error between the intermediate transferring unit 240 and the plurality of photosensitive unit 220 can not be generated due to vibration generated by rotation of the intermediate transferring unit 240.

The photosensitive body supporting unit 213 supports the photosensitive unit 220 provided in a plural with respect to the intermediate transferring unit 240 to be distanced with a predetermined interval. The photosensitive body supporting unit 213 uniformly maintains the position of the photosensitive unit 220 to prevent the position error between the photosensitive unit 220 and the intermediate transferring unit 240 from being generated during a use. Here, the photosensitive body supporting unit 213 and the intermediate transferring housing 211 are integrally provided to minimize the position error.

A developer storing coupling unit 215 to which the developer storing unit 230 is coupled may be provided to one side of the photosensitive body supporting unit 213. The developer storing coupling unit 215 guides the developer storing unit 230 to the photosensitive unit 220 so that a developing roller 233 of the developer storing unit 230 can be contactably coupled to a photosensitive body 223 of the photosensitive unit 220, and supports the developer storing unit 230 so that the position thereof can be stably maintained. The photosensitive body 223 is rotatably mounted in the intermediate transferring housing 211. The developer storing coupling unit 215 may further include a supporting protrusion (not illustrated) to support the position of the developer storing unit 230 coupled to an inner unit or portion thereof. The supporting protrusion may be provided to elastically protrude and retreat like a button, and may be coupled to an insertion hole (not illustrated) of the developer storing unit 230.

The developer storing coupling unit 215 has an opening (not illustrated) corresponding to the size and shape of the developer storing unit 230. A predetermined protecting film (not illustrated), etc., may be attached to the opening in a product delivery to prevent an inflow of a foreign substance, and may be detached therefrom by a coupling force when the developer storing unit 230 is coupled. The developing storing coupling unit 215 may be provided to each photosensitive unit 220.

A handle unit (not illustrated) may be provided to one side of the sub frame 210. The handle unit facilitates handling of a user when the user mounts and detaches the sub frame 210 to and from the main frame 110. The handle unit may be positioned at a position at which a mounting force of the user is minimal with respect to a direction in which the developing-transferring module 200 is mounted to the main frame 100. The handle unit may have a known shape.

The sub frame 210 may have a proper shape to correspond to an interval and shape between the photosensitive units 220, the shape of the main frame 110, etc. Also, the sub frame 210 may have a proper durability against an external impact, and may be formed of material having a small thermal deformation ratio.

The plurality of photosensitive units 220 are distanced from the intermediate transferring unit 240 with a predetermined interval by the photosensitive body supporting unit 213 of the sub frame 210, and primarily transfer the developer to the intermediate transferring unit 240 when a print signal is supplied. The photosensitive unit 220 includes the photosensitive body 223, a surface of which is applied with the developer, a charging roller 225 to charge the surface of the photosensitive body 223 to a predetermined potential level, a cleaning blade 227 to detach a remaining developer not being transferred to the intermediate transferring unit 240 from the surface of the photosensitive body 223, and a photosensitive body frame 221 formed in the photosensitive body supporting unit 213 to support the former mentioned units with respect to the sub frame 210.

The photosensitive unit 220 is provided to correspond to the number of a kind of colors in the developer storing unit 240. The photosensitive units 220 according to the present exemplary embodiment are provided as four units to correspond to yellow (Y), magenta (M), cyan (C) and black (K) developers.

The intermediate transferring unit 240 is disposed inside the sub frame 210 to be contacted with the plurality of photosensitive units 220. If the sub frame 210 is mounted to the main frame 110, the intermediate transferring unit 240 is primarily transferred with the developer from the plurality of photosensitive bodies 223, and secondarily transfers the primarily transferred developer to the record medium supplied from a record medium supplying unit 120.

The intermediate transferring unit 240 may employ a intermediate transferring belt type or a intermediate transferring drum type. As illustrated therein, the intermediate transferring unit 240 according to the present exemplary embodiment employs the intermediate transferring drum type having a small speed variation and a small deformation by a surrounding condition. The intermediate transfer drum may be provided with coating a conductive body by a semi conductive rubber material. Here, the semi conductive rubber material may be provided with coating a surface of chloroprene rubber (CR) (neoprene), ethylene propylene dienemethylene (EPDM), nitrile butadiene rubber (NBR), natural rubber (NR), etc., by urethane or fluorine rubber (FR). Accordingly, a release property of the developer can be improved.

Figure 3A:
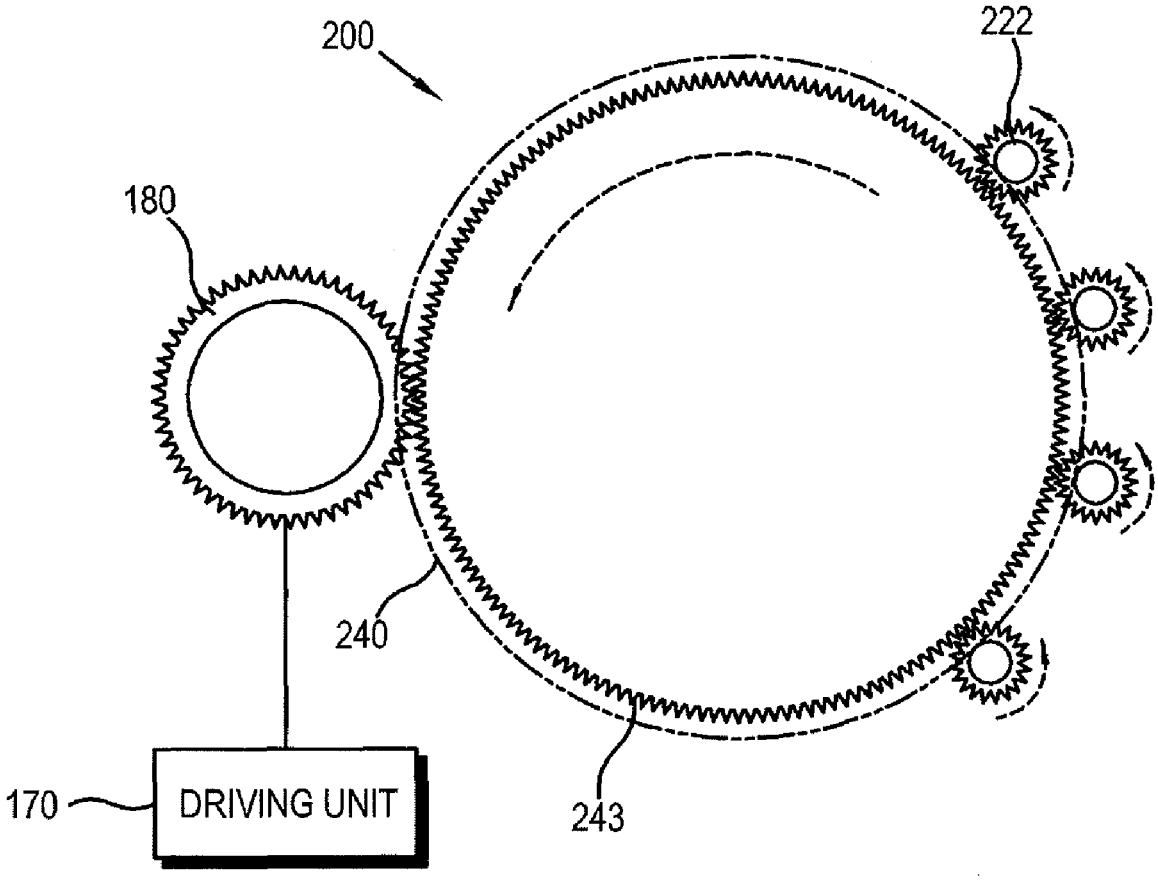
FIGS. 3A to 3C illustrate an example of a deviation from reassembling of the developing-transferring module according to the exemplary embodiment of the present general inventive concept.

When the sub frame 210 is mounted to the main frame 110, the intermediate transferring unit 240 receives a driving force from a driving unit 170 of the main frame 110 to rotate. Here, as illustrated in FIG. 3A, a intermediate transferring gear 243 is provided to an end portion of a rotation shaft 241 (FIGS. 4A and 4B) of the intermediate transferring unit 240 to receive the driving force of the driving unit 170 of the main frame 110. Also, a plurality of photosensitive body driving gears 222 provided to end portions of rotation shafts of the plurality of photosensitive bodies 223 are engaged with the intermediate transferring gear 243 to rotate, thereby receiving the driving force. Since the driving force of the main frame 110 is transmitted to each photosensitive unit 220 through the intermediate transferring gear 243, a driving force transmitting configuration inside the main frame 110 can be simplified.

Figure 3B:
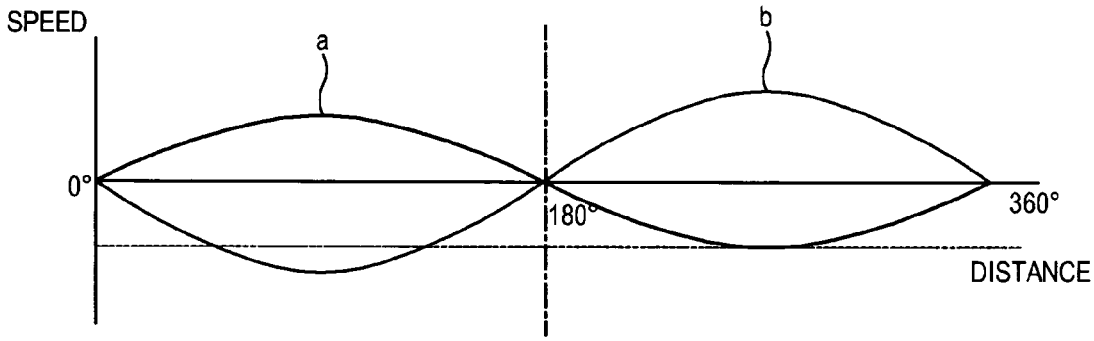
Figure 3C:
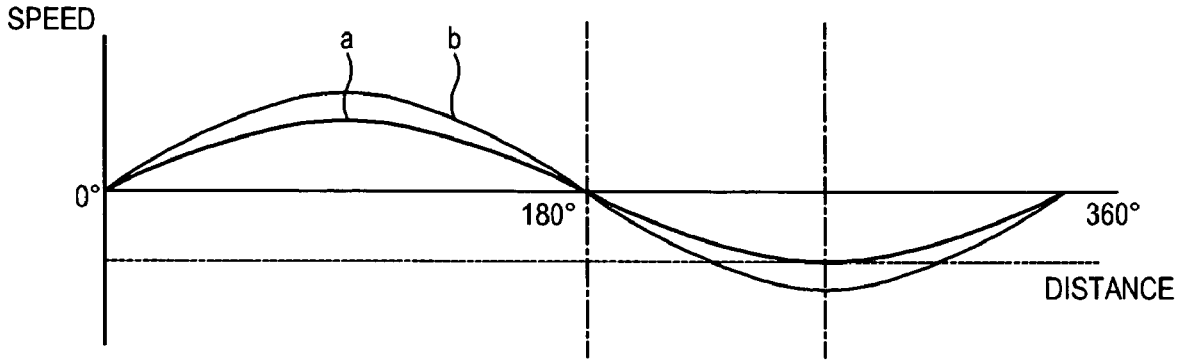

Here, the plurality of photosensitive body driving gears 222 may be assembled with the intermediate transferring gear 243 based on a rotation period property of each photosensitive body 223 experimentally obtained so that a phase difference of each photosensitive body 223 can be minimized. That is, if the phase difference of the rotation period between two photosensitive bodies a and b is 180° as illustrated in FIG. 3B, an assembling angle of one photosensitive body b may be adjusted as illustrated in FIG. 3C so that the phase can be accorded. Accordingly, the color alignment deviation caused by the phase difference of each photosensitive unit 220 can be minimized.

The phase difference between the photosensitive unit 220 and the intermediate transferring unit 240 may exist due to an inherent vibration property of the intermediate transferring unit 240. However, since the intermediate transferring unit 240 provided as a intermediate transferring drum type has a periodically repeated vibration property in rotation, the phase difference can be minimized by assembling the photosensitive unit 220 with a consideration of this periodic property.

Referring to FIGS. 2A and 4A, the developer storing unit 230 according to the present exemplary embodiment is coupled to the sub frame 210 to supply the developer to the photosensitive unit 220. The developer storing unit 230 includes a developer storing casing 231 coupled to the developer storing coupling unit 215 of the sub frame 210, the developing roller 233 provided to one side of the developer storing casing 231 to apply the developer to the photosensitive body 223, a developer storing unit 232 storing the developer, and a supplying roller 235 supplying the developer of the developer storing unit 232 to the developing roller 233.

The developer storing unit 230 may be separately provided by the kind of color of the developer stored therein, or by packaging with four colors, yellow, magenta, cyan and black. In an embodiment of the present general inventive concept, the developer storing unit 230 is separately provided by the kind of color of the developer to be simply replaced if the developer stored therein is exhausted.

The developer storing unit 230 may be integrally coupled to the sub frame 210.

FIGS. 4A to 4C schematically illustrate a configuration of the image forming apparatus 100 mounted with the developing-transferring module 200 according to the exemplary embodiment of the present general inventive concept.

The image forming apparatus 100 according to the exemplary embodiment of the present general inventive concept includes the main frame 110 to which the developing-transferring module 200 is detachably mounted, the record medium supplying unit 120 supplying the record medium to the developing-transferring module 200, a transferring unit 130 disposed opposite to the intermediate transferring unit 240 with respect to a path of the record medium to secondarily transfer the developer of the intermediate transferring unit 240 to the record medium, a light exposing unit 140 to form an electrostatic latent image to the photosensitive body 223 of the developing-transferring module 200, a fixing unit 150 to apply heat and pressure to the record medium to fix the developer to the record medium, and a record medium discharging unit 160 to discharge the record medium formed with an image. Also, the image forming apparatus 100 further includes the driving unit 170 generating a driving force, and a transmitting unit 180 (FIG. 3A) to transmit the driving force of the driving unit 170 to the developing-transferring module 200 and each component and/or unit.

The developing-transferring module 200 is detachably mounted to the main frame 110, and the main frame 110 supports the respective components. The main frame 110 includes a module accommodating unit 111 to which the developing-transferring module 200 is mounted, and a cover 115 opening an inside of the main frame 110 so that the developing-transferring module 200 can be mounted and detached to and from the inside of the main frame 110.

Figure 5:
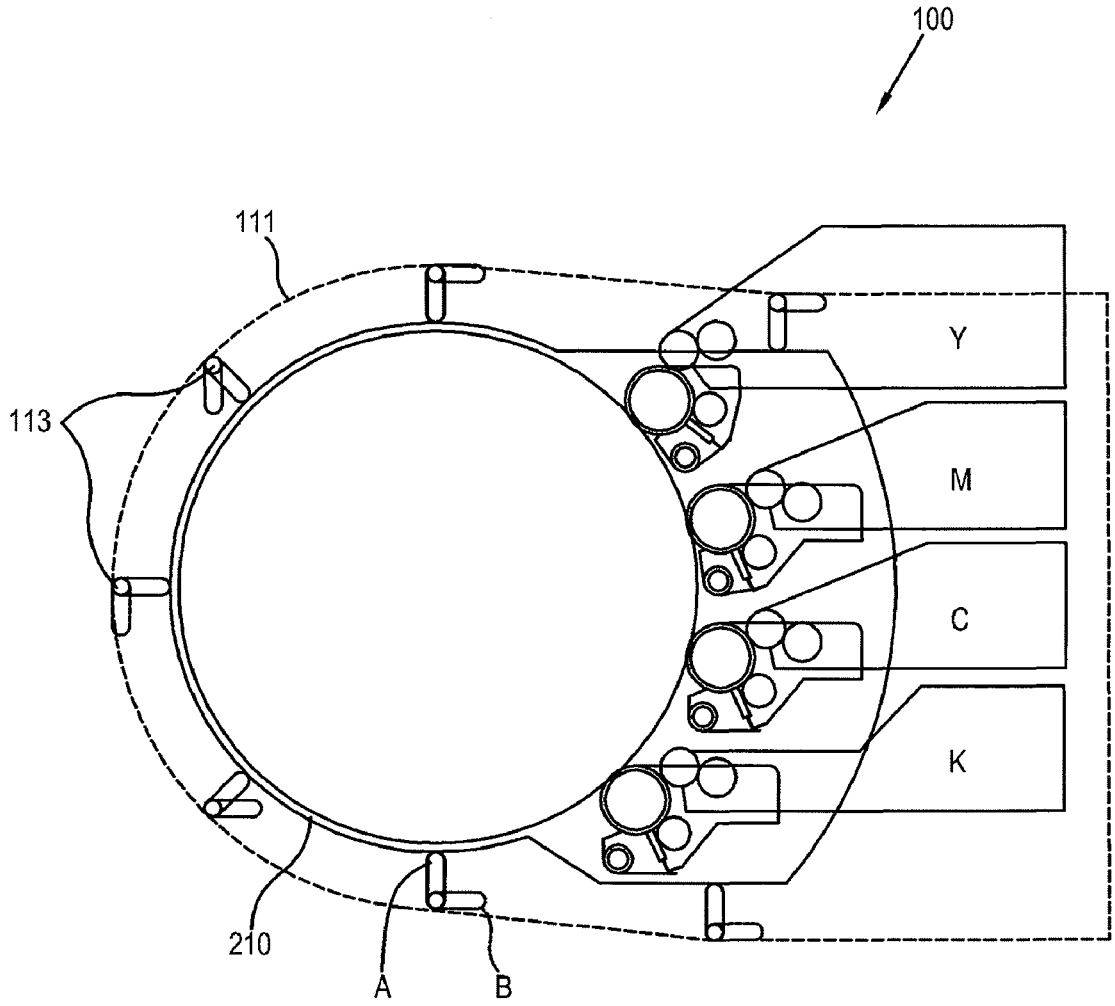
FIG. 5 is a sectional view illustrating a developing-transferring module supporting configuration of a main frame according to the exemplary embodiment of the present general inventive concept.

Referring to FIGS. 4A and 5, the module accommodating unit 111 is provided to correspond to the shape and size of the developing-transferring module 200. The module accommodating unit 111 includes a supporting holder module 113 maintaining the position of the developing-transferring module 200 so that the developing-transferring module 200 mounted in the module accommodating unit 111 can stably transfer the developer to the record medium. The module supporting holder 113 contact-supports the sub frame 210 when the developing-transferring module 200 mounted in the supporting holder module 113 is under operation. Also, the supporting holder module 113 may be provided to move to a position distanced from the developing-transferring module 200 to provide space allowing the developing-transferring module 200 to move when the developing-transferring module 200 is detached from the image forming apparatus 100.

FIG. 5 illustrates an example of the supporting holder module 113. As illustrated therein, the supporting holder module 113 moves to a supporting position A contact-supporting the sub frame 210 when the developing-transferring module 200 is mounted to the module accommodating unit 111, and moves to a distanced position B to be distanced from the sub frame 210 when the developing-transferring module 200 is detached from the module accommodating unit 111 as illustrated in FIG. 4B, thereby providing space in which the developing-transferring module 200 can move.

Since the module accommodating unit 111 is formed on the main frame 110, and the sub frame 210 is fixedly coupled to the module accommodating unit 111 using the supporting holder module 113, the sub-frame 210 is fixedly coupled to the main frame 110. The supporting holder module 113 may include a shaft rotatably coupled to the module accommodating unit 111, and a lever extended from the shaft to move between position A and B.

The supporting holder module 113 may be provided in a plurality to stably support the sub frame 210. Also, the plurality of module supporting holders 113 may be provided to simultaneously move automatically or manually when the developing-transferring module 200 is mounted and detached to and from the module accommodating unit 111. For example, if a user presses a pressing lever (not illustrated) connected with the plurality of supporting holder modules 113 to mount the developing-transferring module 200 to the module accommodating unit 111, the plurality of supporting holder modules 113 may simultaneously move to the distanced position B, and the developing-transferring module 200 may be seated in the module accommodating unit 111. If the pressing lever is released, the module supporting holders 113 may move to the supporting position A.

The supporting holder module 113 may be rotatably mounted on the main frame 110 such that the supporting holder module 113 and the sub frame 210 rotate together to be installed in the main frame 110. It is possible that the supporting holder module 113 is fixedly mounted in the main frame 110, and the sub frame 210 is locked by the supporting holder module 113 when the sub-frame 210 is inserted in the main frame 110 and moves from the insertion position to the mounted position.

The image forming apparatus 100 may sense an entrance when the developing-transferring module 200 is mounted, and automatically move the position of the supporting holder module 113. For example, a radio frequency identification (RFID) tag may be attached to one side of the developing-transferring module 200. If the entrance of the RFID tag is sensed, a predetermined control unit (not illustrated) may move the supporting holder module 113 to the distanced position B. If there is no more position movement of the RFID tag inside the module accommodating unit 111, the supporting holder module 113 may be moved to the supporting position A.

As illustrated in FIGS. 4A and 4B, the cover 115 is rotatably provided to the main frame 110 to open the module accommodating unit 111 to the outside when the developing-transferring module 200 is mounted and detached. The cover 115 is provided to an upper portion of the main frame 110 so that the developing-transferring module 200 can be mounted and detached in a transverse direction to the rotation shaft 241 of the intermediate transferring unit 240. Accordingly, as illustrated therein, the developing-transferring module 200 rotates by a predetermined angle centering on the rotation shaft 241.

The main frame 110 may include a rotation shaft receiving element 147 to receive and support the rotation shaft 241 when the developing-transferring unit 200 is inserted into the main frame 110 and move between the insertion position and the mounted position.

Here, the main frame 110 may further include a guide (not illustrated) to guide the developing-transferring module 200 entered through the cover 115 to the module accommodating unit 111. The guide may be provided to the opposite side surfaces of the main frame 110 to correspond to the rotation shaft 241 of the intermediate transferring unit 240. Here, the interlocking unit 180 may be provided to an end portion of the guide so that the rotation shaft 241 of the intermediate transferring units 240 moved along the guide can be coupled to the interlocking unit 180.

A cover 115 according to another exemplary embodiment of the present general inventive concept may be provided to a main frame 110 in an axial direction of a rotation shaft 241 of a intermediate transferring unit 240. Here, a developing-transferring module 200 may be mounted and detached in the axial direction of the rotation shaft 241. The developing-transferring module 200 is directly mounted to a module accommodating unit 111 through opening of the cover 115, and the rotation shaft 241 of the intermediate transferring unit 240 may be directly coupled with a transmitting unit 180.

A cover 115 according to another exemplary embodiment of the present general inventive concept may be provided to a rear surface of a light exposing unit 140. Here, the light exposing unit 140 is integrally coupled with the cover 115, and moves to interlock with rotation of the cover 115.

Alternatively, a cover 115 may be variously provided to consider the size, shape, etc. of a developing-transferring module 200.

The record medium supplying unit 120 is provided to one side of the main frame 110 to supply the record medium to the developing-transferring module 200. The record medium supplying unit 120 includes a knock up plate 121 on which the record medium is piled, a pick up roller 123 picking up the record medium of the knock up plate 121 out of the knock up plate 121, and an elastic member 125 elastically elevating the knock up plate 121 toward the pick up roller 123. Also, the record medium supplying unit 120 further includes a transporting roller 127 aligning a leading edge of the record medium picked up by the pick up roller 123 and supplying the record medium to the developing-transferring module 200. The record medium supplying unit 120 may include various known configurations.

The transferring unit 130 faces the intermediate transferring unit 240 to interpose the record medium therebetween, and supplies a predetermined transferring voltage to the record medium to secondarily transfer the developer primarily transferred to a surface of the intermediate transferring unit 240 to the record medium. The transferring unit 130 is provided as a typical transferring roller type, and supplies the proper transferring voltage considering the thickness, resistance and other properties of the record medium.

The image forming apparatus 100 according to the present exemplary embodiment of the present general inventive concept includes the transferring unit 130 inside the main frame 110. Alternatively, the transferring unit 130 may be integrally provided with the developing-transferring module 200 as necessary.

Referring to FIG. 4A, the light exposing unit 140 is provided to one side of the main frame 110, and scans light to the photosensitive body 223 based on an image data applied by an output signal to form an electrostatic latent image to the surface of the photosensitive body 223. As illustrated therein, the light exposing unit 140 includes a light source unit (not illustrated) generating light, a polygon mirror assembly 141 scanning the light of the light source unit in a main scanning direction of the photosensitive body 223, a reflecting mirror 143 reflecting the scanned light by the polygon mirror assembly 141 toward the photosensitive body 223, and a light exposing casing 145 accommodating them.

The light exposing unit 140 may be provided in a plurality to correspond to the number of the plurality of photosensitive bodies 223, or less than the number of the plurality of photosensitive bodies 223.

A light exposing unit 140 according to another exemplary embodiment of the present general inventive concept may include an LED array head (not illustrated). The LED array head includes a plurality of LEDs rectilinearly arranged, and a lens controlling light emitted by the LEDs. The plurality of LEDs selectively emit light based on an image data to form an electrostatic latent image to a surface of the photosensitive body 223. If the light exposing unit 140 uses the LED array head, heat deformation due to a temperature increase inside the image forming apparatus 100 can be prevented, thereby minimizing the color alignment error. Various known configurations may be applied to the LED array head.

The fixing unit 150 applies heat and pressure to the record medium to fix the developer secondarily transferred to the record medium by the transferring unit 130. The fixing unit 150 includes a heating roller 151 applying heat to the record medium, and a pressing roller 153 facing the heating roller 151 to apply pressure to the record medium. The pressing roller 153 includes an elastic layer having a predetermined thickness, and rotates to contact with the heating roller 151 to form a nip. The record medium proceeds between the nip to receive the heat and the pressure. The fixing unit 150 may include a known configuration.

The record medium discharging unit 160 discharges the record medium on which the developer is fixed by the fixing unit 150 and the image completely formed to the outside. The record medium discharging unit 160 includes a record medium discharging roller 161 discharging the record medium passing through the fixing unit 150 to the outside. Also, the record medium discharging unit 160 may further include a direction converting unit (not illustrated) converting the direction of the record medium passing through the fixing unit 150 so that the record medium can be reentered to the developing-transferring module 200 if the opposite side of the record medium is to be formed with another image.

Hereinafter, an assembling process of the image forming apparatus 100 according to the exemplary embodiment of the present general inventive concept will be described by referring to FIGS. 2A to 5.

At first, as illustrated in FIG. 2B, the developer storing unit 230 is coupled to the developer storing coupling unit 215 of the sub frame 210 of the developing-transferring module 200. The developing-transferring module 200 to which the developer storing unit 230 is coupled is mounted to the main frame 110.

For this, the cover 115 of the main frame 110 is opened, and the supporting holder module 113 is moved to the distanced position. A user presses the developing-transferring module 200 to be mounted in the module accommodating unit 111. Then, the supporting holder module 113 is moved to the supporting position to stably support the developing-transferring module 200.

When the developing-transferring mode 200 is inserted into the main frame 110 in an insertion position, the intermediate transferring gear 243 becomes engaged (e.g., meshes) with the transmitting unit 180. It is possible that when the developing-transferring module 200 rotates between the insertion position and a mounted position in the main frame 110, the intermediate transferring gear 243 and the transmitting unit 180 rotate together. It is also possible that once the developing-transferring module 200 is mounted in the main frame 110 in an insertion direction, the intermediate transferring gear 243 and the transmitting unit 180 contact each other, and the driving unit 170 drives the transmitting unit 180 and the intermediate transferring gear 243 to move the developing-transferring module 200 to a mounting direction with respect to the main frame 110. The developing-transferring module 200 can be removed from the image forming apparatus in an opposite process to the above assembling process.

Hereinafter, an image forming process of the image forming apparatus 100 according to the exemplary embodiment of the present general inventive concept completely assembled as mentioned above will be described. If a user supplies the print signal, the pick up roller 123 of the record medium supplying unit 120 picks up the record medium of the knock up plate 121 to be transported to the developing-transferring module 200. Here, the plurality of photosensitive bodies 223 are charged by each charging roller 225 to have the predetermined electrical potential.

The light exposing unit 140 scans light to correspond to the image data to form the electrostatic latent image on a surface of the plurality of photosensitive bodies 223. The supplying roller 235 of the developer storing unit 230 supplies the developer of the developer storing unit 232 to the developing roller 233. The developing roller 233 selectively applies the developer to the electrostatic latent image on the surface of the photosensitive body 223. Each photosensitive body 223 of its own color primarily transfers the developer to the surface of the intermediate transferring unit 240 of a drum type. Accordingly, a developer image is formed on the surface of the intermediate transferring unit 240 by an overlap of each developer.

Here, since each photosensitive body 223 maintains a constant relative position with respect to the intermediate transferring unit 240 by the sub frame 210, the color alignment can be uniformly maintained despite a long time use.

The transferring unit 130 supplies the transferring voltage to a rear surface of the record medium to secondarily transfer the developer image on the surface of the intermediate transferring unit 240 to the record medium. The developer secondarily transferred to the record medium receives heat and pressure in the fixing unit 150 to be fixed to a surface of the record medium. The record medium completely formed with the image through the fixing unit 150 is discharged to the outside by the discharging unit 160.

As described above, the image forming apparatus according to various embodiment of the present general inventive concept includes the intermediate transferring unit of the drum type, thereby solving problems due to heat deformation speed variation in the conventional intermediate transferring belt.

Also, since the plurality of photosensitive units are coupled to the sub frame together with the intermediate transferring unit, the color alignment deterioration caused by the positional variation of each photosensitive body in replacing the conventional developing unit can be prevented in advance.

Also, since the color alignment deterioration is prevented, an automatic color alignment process performed after replacing each developing unit by a predetermined print medium can be omitted, thereby reducing an initial print time.

Also, since the intermediate transferring belt occupying a large space inside the conventional image forming apparatus is unnecessary, the size of the image forming apparatus can be decreased.

The image forming apparatus according to various embodiment of the present general inventive concept may be applied to a multifunction device including a scanning unit, a facsimile unit, etc.

As described above, various embodiments of the present general inventive concept provides a developing-transferring module and an image forming apparatus having the same including a intermediate transferring unit and a photosensitive unit integrally provided inside a sub frame, thereby preventing a color alignment deterioration in advance from an assembling tolerance.

Although a few exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A developing-transferring module usable with and image forming apparatus, comprising:

a sub frame which is detachably mounted to a main frame;

a plurality of photosensitive units which are supported by the sub frame and have a predetermined interval therebetween, each of the photosensitive units comprising a photosensitive body to which developer is attached; and a single intermediate transferring unit which is supported by the sub frame to face the plurality of photosensitive units so that the developer of the photosensitive units can be primarily transferred thereto, and secondarily transfers the primarily transferred developer to a record medium of the main frame, wherein the intermediate transferring unit comprises an intermediate transferring drum.

2. The developing-transferring module according to claim 1, wherein each of the photosensitive units comprises a charging roller which charges the photosensitive body to have a predetermined electrical potential.

3. The developing-transferring module according to claim 1, further comprising:

a developer storing unit which is coupled to the sub frame to supply the developer to the photosensitive body.

4. The developing-transferring module according to claim 3, wherein the developer storing unit is integrally coupled to the sub frame.

5. The developing-transferring module according to claim 3, wherein the developer storing unit comprises:

a developing roller which applies the developer to the photosensitive body;

a developer storing unit which stores the developer; and a supplying roller which supplies the developer of the developer storing unit to the developing roller.

6. The developing-transferring module according to claim 1, further comprising:

a transferring roller which is provided to one side of the intermediate transferring unit to supply a predetermined transferring voltage so that the developer of the intermediate transferring unit can be transferred to the record medium.

7. The developing-transferring module according to claim 6, wherein the transferring roller is integrally provided with the sub frame.

8. The developing-transferring module according to claim 1, wherein the intermediate transferring drum comprises a conductive body with a semi conductive rubber material layer formed thereon.

9. The developing-transferring module according to claim 1, wherein the intermediate transfer drum comprises a conductive body with an outer rubber material layer formed thereon, the outer rubber material layer comprises at least one of chloroprene rubber, ethylene propylene dienemethylene, nitrile butadiene rubber, natural rubber, and fluorine rubber.

10. An image forming apparatus, comprising:

a main frame;

a record medium supplying unit which is provided to a first side of the main frame and stores a record medium;

a developing-transferring module comprising:

a sub frame which is detachably mounted to a main frame;

a plurality of photosensitive units which are supported by the sub frame to have a predetermined interval therebetween, each of the photosensitive units comprising a photosensitive body to which developer is attached;

a single intermediate transferring unit which is supported by the sub frame and located adjacent to the plurality of photosensitive units so that the developer of the photosensitive units can be primarily transferred thereto, and secondarily transfers the primarily transferred developer to a record medium of the main frame; and a light exposing unit which is provided to a second side of the main frame to form an electrostatic latent image to the photosensitive body of the developing-transferring module, wherein the intermediate transferring unit comprises an intermediate transferring drum.

11. The image forming apparatus according to claim 10, wherein the main frame comprises:

a developing-transferring module holder which supports the developing-transferring module detachably mounted to the main frame.

12. The image forming apparatus according to claim 11, wherein the developing-transferring module holder moves between a supporting position in which the developing-transferring module holder contact-supports the developing-transferring module, and a distanced position in which the developing-transferring module holder is distanced from the developing-transferring module so that the developing-transferring module can be detached from the main frame.

13. The image forming apparatus according to claim 10, wherein the main frame comprises:

a driving unit which generates a driving force; and a transmitting unit which transmits the driving force of the driving unit to the intermediate transferring unit of the developing-transferring module.

14. The image forming apparatus according to claim 11, wherein the developing-transferring module comprises:

a driving gear; and the intermediate transferring unit comprises a intermediate transferring gear which is engaged with the driving gear.

15. The image forming apparatus according to claim 14, wherein the plurality of photosensitive bodies comprise:

a plurality of photosensitive body driving gears which rotate to engage with the intermediate transferring gear; and the plurality of photosensitive body driving gears are assembled to the intermediate transferring gear to minimize a color alignment deviation of each photosensitive body which applies the developer to the intermediate transferring unit.

16. The image forming apparatus according to claim 10, wherein the light exposing unit comprises a light emitting diode (LED) array head.

17. The image forming apparatus according to claim 10, wherein the main frame comprises a cover through which the developing-transferring module is carried in and out.

18. The image forming apparatus according to claim 17, wherein the cover is provided to the main frame in a transverse direction to a rotation axis of the intermediate transferring unit.

19. The image forming apparatus according to claim 17, wherein the cover is provided in a rotation axis direction of the intermediate transferring unit.

20. The image forming apparatus according to claim 10, wherein the intermediate transferring drum comprises a conductive body with a semi conductive rubber material layer formed thereon.

21. The image forming apparatus according to claim 10, wherein the intermediate transfer drum comprises a conductive body with an outer rubber material layer formed thereon, the outer rubber material layer comprises at least one of chloroprene rubber, ethylene propylene dienemethylene, nitrile butadiene rubber, natural rubber, and fluorine rubber.

22. The image forming apparatus according to claim 10, wherein the sub frame is rotatable in the main frame between an operating position to enable printing operations to be performed and a tilted position, a developer storing unit associated with each of the photosensitive units is attached to the sub frame at the tilted position, and the image forming apparatus is operable to perform printing operations when the sub frame is rotated to the operating position.

23. The image forming apparatus according to claim 22, wherein the sub frame is rotatable in the main frame from the operating position to the tilted position to enable the sub frame to be detached and removed from the main frame.

24. The image forming apparatus according to claim 10, wherein the sub frame includes a photosensitive body supporting section to support the plurality of photosensitive units.

25. The image forming apparatus according to claim 22, wherein the sub frame includes a plurality of developer storage coupling portions to support the developer storing units.

26. A developing-transferring module usable with an image forming apparatus, comprising:

a plurality of photosensitive bodies which are disposed with a predetermined interval; and a single intermediate transferring unit which is integrally provided with the photosensitive bodies so that a relative position therebetween can be uniformly maintained and disposed adjacent to the photosensitive bodies so that developer of the photosensitive bodies can be primarily transferred thereto, wherein the intermediate transferring unit comprises an intermediate transferring drum.

27. The developing-transferring module according to claim 26, further comprising:

a sub frame which supports the photosensitive bodies and the intermediate transferring unit together.

28. A developing-transferring unit usable with an image forming apparatus having a main frame, the unit comprising:

a plurality of photosensitive units;

a single intermediate transferring unit; and a sub frame detachably mounted to the main frame to integrally support the plurality of the photosensitive units and the single intermediate transferring unit so that a relative position therebetween is maintained, wherein the intermediate transferring unit comprises an intermediate transferring drum.

29. An image forming apparatus, comprising:

a main frame; and a developing-transferring unit comprising:

a plurality of photosensitive units;

a single intermediate transferring unit; and a sub frame detachably mounted to the main frame to integrally support the plurality of the photosensitive units and the single intermediate transferring unit so that a relative position therebetween is maintained, wherein the intermediate transferring unit comprises an intermediate transferring drum.

30. The image forming apparatus according to claim 29, wherein the intermediate transferring drum comprises a conductive body with a semi conductive rubber material layer formed thereon.

31. The image forming apparatus according to claim 29, wherein the intermediate transfer drum comprises a conductive body with an outer rubber material layer formed thereon, the outer rubber material layer comprises at least one of chloroprene rubber, ethylene propylene dienemethylene, nitrile butadiene rubber, natural rubber, and fluorine rubber.

32. The image forming apparatus according to claim 29, wherein the sub frame includes a photosensitive body supporting section to support the plurality of photosensitive units.

33. The image forming apparatus according to claim 32, wherein the sub frame includes a plurality of developer storage coupling portions, each of the developer storage coupling portions adapted to support a developer storing unit.

34. The image forming apparatus according to claim 29, wherein the sub frame is rotatable in the main frame between an operating position to enable printing operations to be performed and a tilted position to enable the developer of each of the photosensitive units to be removed from the sub frame and replaced with a replacement developer.

35. The image forming apparatus according to claim 34, wherein the sub frame is rotatable in the main frame from the operating position to the tilted position to enable the sub frame to be detached and removed from the main frame.

36. The image forming apparatus according to claim 29, further comprising a light exposing unit which is provided at the main frame to form an electrostatic latent image to a photosensitive body of each of the photosensitive units of the developing-transferring module, wherein the single intermediate transferring drum is located adjacent to the plurality of photosensitive units so that developer image formed on the photosensitive body of each of the photosensitive units can be primarily transferred to the single intermediate transferring drum, and secondarily transfers the primarily transferred developer from the single intermediate transferring drum to a record medium being fed within the main frame.

37. A developing-transferring unit, comprising:

a single intermediate transferring drum having a periodic vibration property in a rotational state; and a plurality of photosensitive units to engage the intermediate transferring drum, wherein the plurality of photosensitive units are integrally assembled with respect to the single intermediate transferring drum to minimize a phase difference between the plurality of photosensitive units and the intermediate transferring drum based on the periodic vibration property in the rotational state of the intermediate transferring drum.

* * * * *